US006042100A

United States Patent [19]

Jones et al.

[11] Patent Number: 6,042,100

[45] Date of Patent: Mar. 28, 2000

[54] SOFT PINCH ROLLER TO REDUCE HAND-OFF ERROR

[75] Inventors: Jeffrey E. Jones, Oceanside; Glenn Gaarder, Ramona; Samuel A. Stodder, Encinitas, all of Calif.

[73] Assignee: Hewlett-Packard Company, Palo Alto, Calif.

[21] Appl. No.: 09/034,490

[22] Filed: Mar. 3, 1998

[51] Int. Cl.[7] ..... B65H 3/44; B65H 5/26; B65H 9/04

[52] U.S. Cl. ..... 271/9.13; 271/242

[58] Field of Search ..... 271/109, 314, 271/10.11, 273, 242, 9.13; 492/56

[56] References Cited

U.S. PATENT DOCUMENTS

| | | | |
|---|---|---|---|
| 4,269,594 | 5/1981 | Umans et al. | 271/273 X |
| 4,425,694 | 1/1984 | Sommerville | 271/273 X |
| 5,163,675 | 11/1992 | Sunohara | 271/272 X |
| 5,387,172 | 2/1995 | Habenicht et al. | 492/56 X |

OTHER PUBLICATIONS

Hewlett–Packard Drawing No. B–5061–7823–1, "Pinchroller," Nov. 26, 1990 (Cranford, Kevin).

*Primary Examiner*—Christopher P. Ellis
*Assistant Examiner*—Kenneth W Bower
*Attorney, Agent, or Firm*—Jerry Potts

[57] ABSTRACT

A pinch roller acts in combination with a drive roller to provide a nip through which sheets are passed in a sheet handling system. To reduce hand-off errors in the line feed accuracy of the sheet handling system, the pinch roller includes a compliant outer surface and soft undersurface volume. The flexibility of the outer surface allows the pinch roller to shift its holding force from the media to the pinch roller as the media leaves the nip between the rollers. This reduces the force seen by the media in the direction of the media travel, thus reducing the localized push on the back edge of the media. The soft undersurface volume is formed by a foam core.

19 Claims, 4 Drawing Sheets

20
30
32
40
42
54A
52
52A
82
54
50
54B
58
56
72
70
76
74
60
CONTROLLER
DRIVE MOTOR
GEAR TRAIN

FIG. 6A
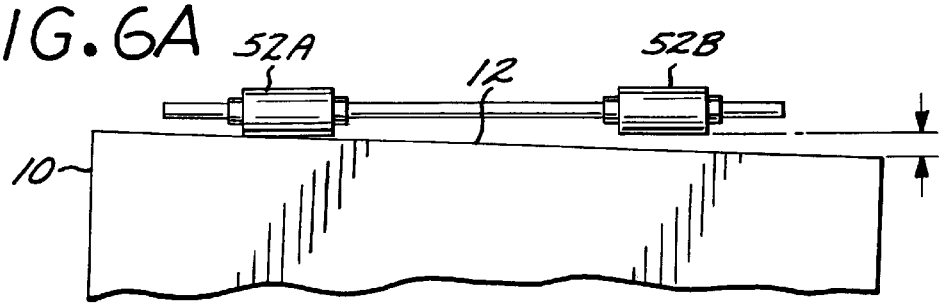
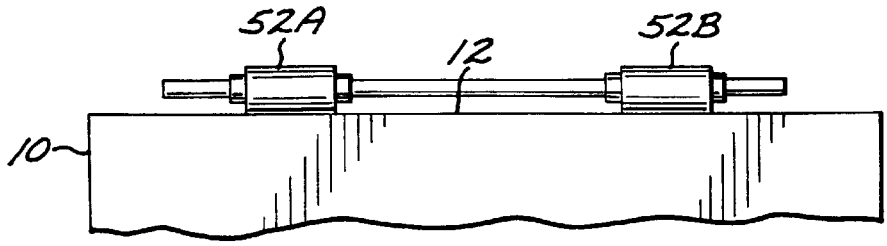
FIG. 6B
FIG. 7A
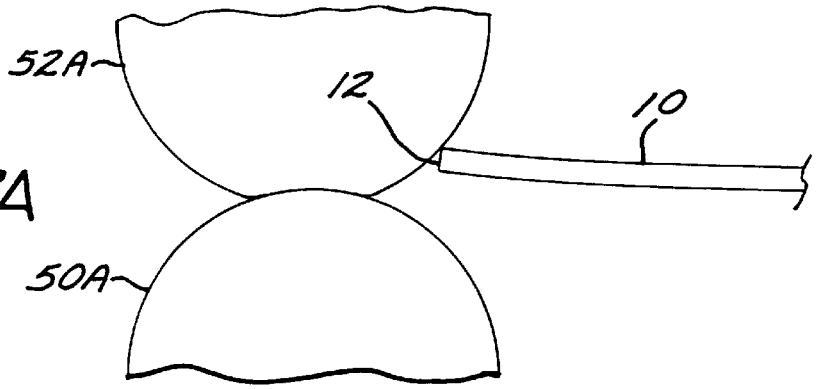
FIG. 7B
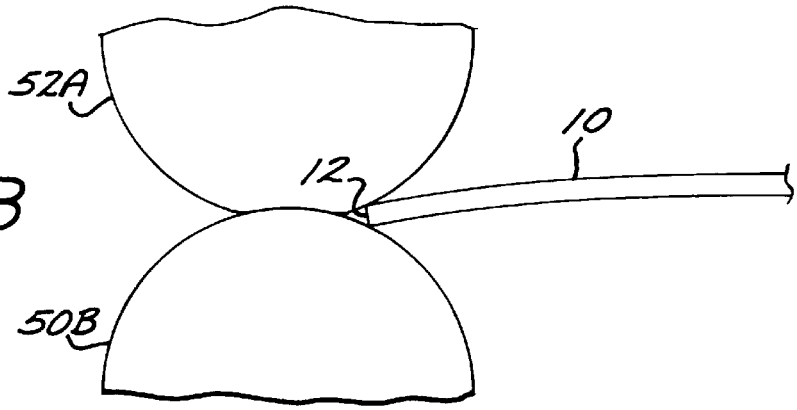

SOFT PINCH ROLLER TO REDUCE HAND-OFF ERROR

TECHNICAL FIELD OF THE INVENTION

The present invention relates to sheet handling systems for feeding sheets along a path, and more particularly to a technique for reducing hand-off error in such systems.

BACKGROUND OF THE INVENTION

Office equipment such as printers, scanners, copiers and facsimile machines are in universal use. These types of office equipment often include sheet handling systems to advance sheets of a media such as paper along a media path. Recently, new types of office equipment have been introduced, which combine functions of various machines into a single piece of equipment. These multi-purpose machines include, for example, the "OfficeJet" series of machines marketed by Hewlett-Packard Company, which includes functions of a printer and a facsimile machine.

Many of these multi-function machines use two input media sources, with a drive to pick a sheet of media such as paper from one of the input sources and pass the picked sheet through a shared media path. For example, the machine may include an optical scanner and a printing apparatus, such as a scanning carriage holding an ink-jet print cartridge for example, disposed along a common media path through the machine. One input media source can be for holding documents to be scanned by the optical scanner, and the other media source can be for holding a supply of blank paper for printing. In one mode of operation, document sheets are sequentially fed from the first input source into the shared media path and past the scanning apparatus for optical scanning. In another mode of operation, blank sheets are fed from the second input source into the shared media path and to a printing area for printing by the printing apparatus.

The sheet handling systems of these types of office equipment typically include drive rollers and corresponding pinch or idler rollers, which engage a sheet and drive the sheet along the media path. One system, the large format Design Jet 650C, an ink-jet plotter marketed by Hewlett-Packard Company, the assignee of this application, employs a hard solid rubber drive roller with a hard solid rubber pinch roller. Another system, the Photo Smart (TM) printer marketed by the assignee, employs a grit-surfaced drive roller with a hard rubber pinch roller.

Some sheet handling systems include more than one set of drive/pinch rollers along the media path. An important characteristic of sheet handling systems is the line feed accuracy, which is a measure of the error between the commanded movement of the sheet along the media path and the actual movement resulting from the commanded movement. While ideally there is no error, in practice there will be some error due to various factors including hand-off error. The hand-off error results when the media is engaged by a new set of drive/pinch rollers, or is released by a set of drive/pinch rollers. This invention addresses the problem of hand-off error in sheet handling systems.

SUMMARY OF THE INVENTION

An improved pinch roller is described for a sheet handling system including at least one drive roller and a pinch roller positioned to create a nip into which a sheet is passed. The pinch roller includes a compressible or deformable core member, and optionally a compliant skin covering a outer surface of the core member. The skin is formed of a material having a low coefficient of friction. The nip is formed between an outer surface of the compliant skin and an outer surface of the drive roller. In a preferred embodiment, the core member comprises a soft foam member having a cylindrical outer surface, and the skin inner surface is in contact with the cylindrical outer surface of the foam member.

BRIEF DESCRIPTION OF THE DRAWING

These and other features and advantages of the present invention will become more apparent from the following detailed description of an exemplary embodiment thereof, as illustrated in the accompanying drawings, in which:

FIG. 5A shows the entrance of the leading edge of the medium into the nip. FIG. 5B shows the condition of the pinch roller after the leading edge has completely passed through the nip. FIG. 5C shows the condition of the pinch roller as the trailing end of the medium 10 approaches the nip. FIG. 5D shows the trailing edge at the nip. FIGS. 5E and 5F progressively show the trailing edge leaving the nip.

FIG. 6A is a top view illustrating the skewed leading edge of a sheet approaching the nips between spaced sets of rollers including a pinch roller in accordance with the invention. FIG. 6B illustrates the leading edge after completion of a de-skew operation.

FIG. 7A is a side view of the nip between a soft pinch roller in accordance with the invention and a drive roller, with the leading edge of a sheet approaching the nip. FIG. 7B is a side view illustrating the leading edge after it slides down the side of the pinch roller into the nip.

DETAILED DESCRIPTION OF THE PREFERRED EMBODIMENT

Figure 1:
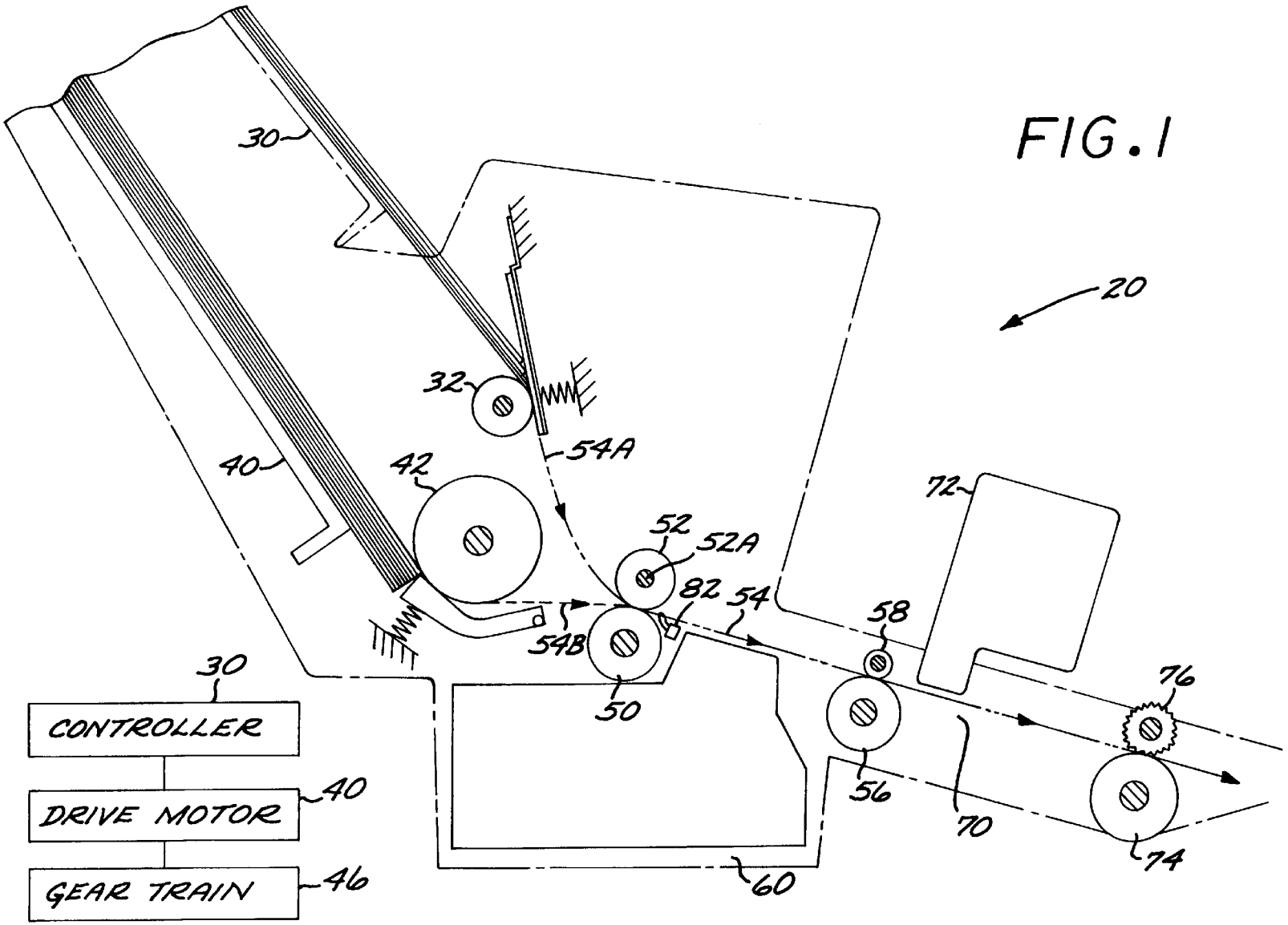
FIG. 1 is a simplified side view of the media path through a multi-function office equipment embodying this invention.

FIG. 1 is a simplified side view of an exemplary multi-function office equipment 20 employing this invention. This equipment can be, for example, a multi-function device of the type described in commonly assigned U.S. Pat. No. 5,391,009, or a device as described in co-pending application Ser. No. 08/971,012, filed Nov. 14, 1997, entitled THREE STATE SHIFTING DEVICE FOR MULTI-FUNCTION OFFICE EQUIPMENT. This co-pending application and U.S. Pat. No. 5,391,009 are incorporated herein by this reference. The device 20 performs functions such as optically scanning imagery from a document picked from an automatic document feeder (ADF) 30 by ADF pick roller 32, or printing onto a sheet picked from an automatic sheet feeder (ASF) 40 by ASF pick roller 42. The device 20 can be a facsimile machine, or a multi-function office equipment such as a combination printer/scanner/facsimile machine. The device 20 includes a controller 30, a drive motor 40 and gear train 46 which couples drive force from the motor to the device drive rollers. An exemplary controller, motor and gear train suitable for the purpose are described more particularly in application Ser. No. 08/971,012 (as controller 90, drive motor 100, gear train 80). While the particular device described in application Ser. No. 08/971,012 utilizes a single motor to drive the rollers through a gear train, it will be appreciated that the present invention has utility with other systems. For example, different motors and gear trains can be employed to drive different ones of the drive rollers.

The picked document or sheet is fed through the nip between a pre-scan drive roller set 50 and idler roller set 52, tripping an edge sensor 82, and passed along a feed path 54 to the scanner station 60, through the nip between a main drive roller set 56 and idler roller set 58 to a printing station 70, wherein printing is performed via ink-jet cartridge 72, mounted on a traversing carriage (not shown) for movement transverse to the feed path. The sheet is then passed through the nip between a kick-out driver roller set 74 and star pinch roller set 76 to be ejected from the machine onto an output tray (not shown). This invention is concerned with the drive for picking and driving the document or sheet through the feed path.

While only one roller of each roller set 50, 52, 56, 58, 74 and 76 are visible in the side view of FIG. 1, it will be appreciated that in an exemplary embodiment, each set has two or more rollers. The roller sets 50, 56 and 74 are mounted on shafts relative to respective pinch roller sets 52, 58 and 76, with the pinch roller sets spring loaded toward the roller sets 50, 56, 74 to provide gripping force on the sheet adjacent each longitudinal side of the sheet. The edge sensor 82 is mounted in the feed path after the pre-scan roller set 50, such that the sensor will be tripped after the leading edge has entered the nip between each pre-scan roller and its corresponding pinch roller, and is released after the trailing edge of the picked sheet passes.

In order to reduce hand-off errors in the line feed accuracy of the system, a pinch roller is used which includes a compliant outer surface and soft undersurface volume. In the system 20, this new pinch roller can be employed as the pinch roller 52, to reduce the hand-off error as the trailing edge of the media leaves the nip of the pre-scan drive roller 50 and pinch roller 52 while still under the influence of the main drive roller 56 and pinch roller 58. It appears that the flexibility of the outer surface allows the pinch roller to shift its holding force from the media to the pinch roller as the media leaves the nip between the rollers 50 and 52. This reduces the force seen by the media in the direction of the media travel, thus reducing the localized push on the back edge of the media.

Figure 2:
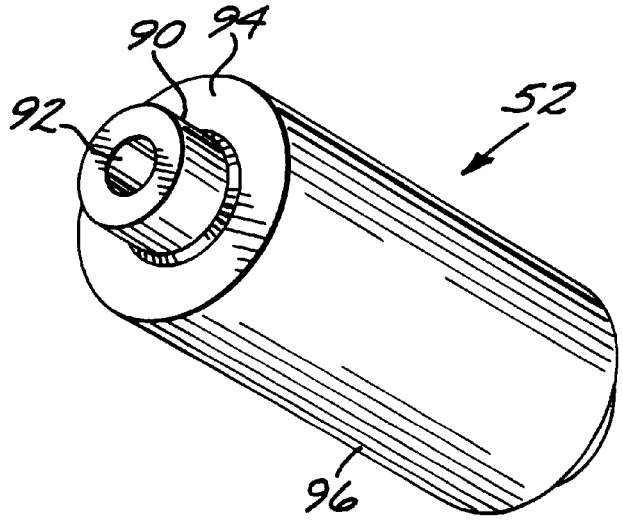
FIG. 2 is an isometric view of an exemplary embodiment of a compliant roller in accordance with this invention, and used in the apparatus of FIG. 1.

FIG. 2 is an isometric view of an exemplary embodiment of the compliant roller 52 in accordance with this invention. The roller includes a hollow polycarbonate sleeve or hub 90 which has a central opening 92 formed therethrough for receiving the roller axle 52A (FIG. 1). An annular foam tire member 94 is attached to the outer surface of the sleeve by adhesive to prevent slippage. In this exemplary embodiment, the foam has a hardness of approximately Shore-A 7+/−3. An exemplary material suitable for the purpose is cellular urethane. In general, the softer the pinch roller, the better the performance in reducing hand-off error. Of course, there will be a tradeoff in the effectiveness of the pinch roller in its function as a pinch roller as the roller becomes very soft.

The roller 52 further includes an outer cover or skin 96 attached to the outer surface of the foam tire by adhesive. In this exemplary embodiment, the skin is a layer of polyester, e.g. MYLAR (TM), of thickness 0.05 mm +/−0.02 mm. The skin 96 is thin enough to remain compliant; as the foam tire member 94 is selected to be a harder material, the skin can be thicker. The skin 96 has a low coefficient of static friction, no greater than about 0.33 against a plain paper such as the Hewlett-Packard multipurpose paper, in an exemplary embodiment. In this embodiment, the roller 52 comprises a linearly inelastic sleeve 96 covering a volumetrically compressible core (i.e. the foam tire 94).

In the exemplary embodiment, the rollers 50 and 52 have the following characteristics. The hub 90 has an outer diameter of 6.4 mm, with a length of 32.2 mm. The foam tire member 94 has an outer diameter of 12 mm, and a length of about 24 mm. The sleeve 96 has an inner diameter of about 12 mm. The drive roller 50 against which the pinch roller 52 acts has an outer diameter of 15.5 mm, and is fabricated of neoprene, with a hardness in the range of Shore-A 68+/−5. This invention will be employed typically with pinch rollers having an outer diameter less than 50 mm.

One exemplary technique of fabricating the roller 52 is the following. The skin or sleeve 96 is provided in tube form, e.g. from an extrusion process, in lengths of, say, one foot. A urethane adhesive covers the outside surface of the foam core. The sleeve is slid over the adhesive-coated surface of the foam core, while its ends are held in tension to facilitate the process. The resultant sleeved core can then be cut into lengths of appropriate length for a roller 52, and the hubs installed.

The soft foam tire 94 is a key element in the reduction of hand-off error. The tire collapses locally due to contact with the media, providing a distribution of force off the media to the drive roller. The foam tire has a stretchy outer surface which helps the effectiveness of the force transfer, by lowering the force in the direction of the media travel, and providing increased contact area with the drive roller. Preferably, the compressible member has a hysteresis, in that it would compress rapidly but de-compress slowly.

One alternate embodiment of a pinch roller in accordance with the invention includes a hollow hub over which is directly over-molded a soft material for the compressible member. The soft material can be, e.g., neoprene, nitrile or silicon. This roller is less expensive to fabricate than the roller which employs a separate tire and sleeve, which are subsequently assembled together and to a hub. This alternate form of the roller need not employ an outer skin, although such a skin can be added.

Figure 3:
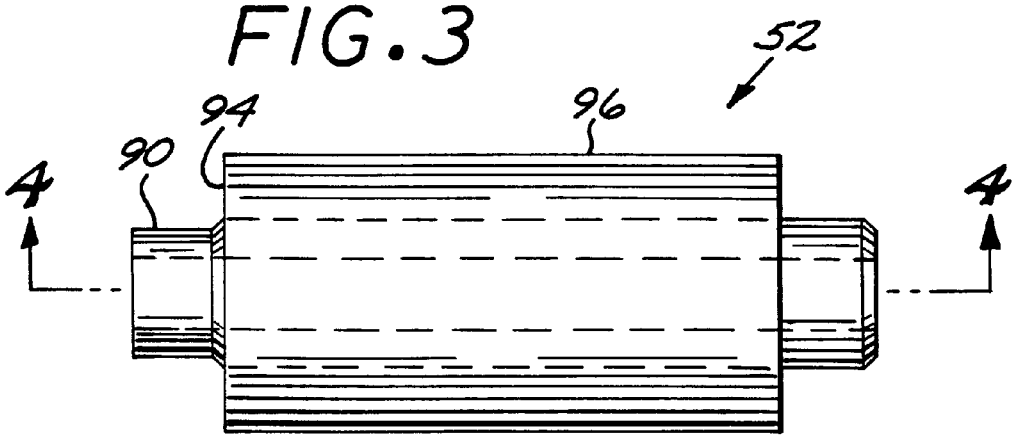
FIG. 3 is a side view of the compliant roller of FIG. 2.
Figure 4:
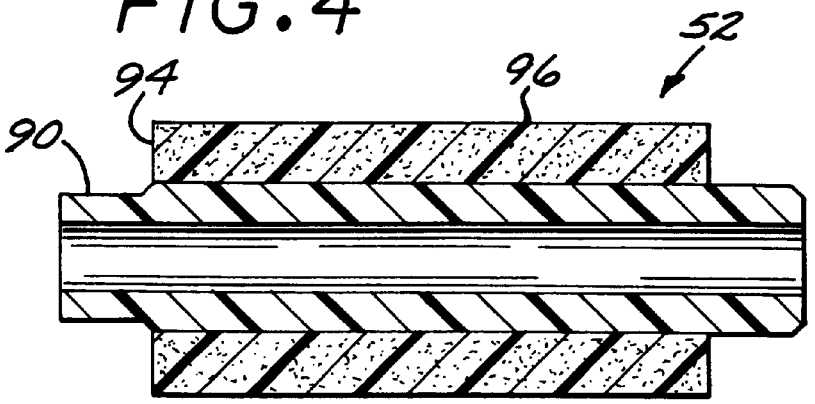
FIG. 4 is a cross-section view of the compliant roller of FIG. 3, taken along line 4—4 of FIG. 3.
Figure 5A:
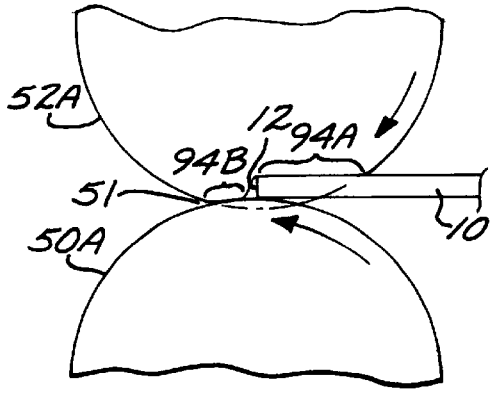
FIGS. 5A–5F are exaggerated side illustrations of the nip between a drive roller and a compliant pinch roller as in FIGS. 2–4, showing a medium in different stages of passage through the nip.

FIGS. 5A–5F are exaggerated side illustrations of the nip 51 between a drive roller 50 and a compliant pinch roller 52 as in FIGS. 2–4, showing a medium 10 of exaggerated thickness in different stages of passage through the nip. FIG. 5A shows the entrance of the leading edge 12 into the nip 51, showing some deformation of the pinch roller due to the thickness of the medium. The pinch roller also has some deformation due to the pressure of the pinch roller against the drive roller.

Figure 5B:
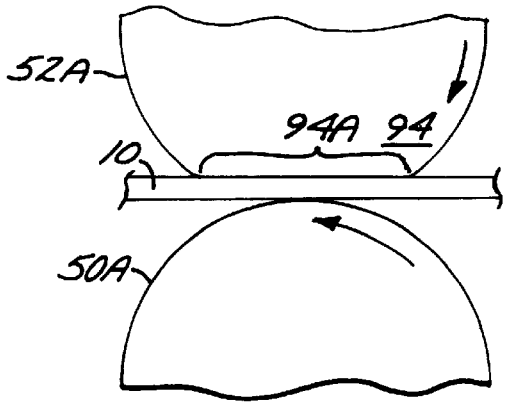

FIG. 5B shows the condition of the pinch roller after the leading edge 12 has completely passed through the nip. The foam tire 94 pinch roller compresses locally and deforms so that a rolling flattened portion 94A is present along an extended interface with the medium 10. The drive roller is relatively hard in comparison to the pinch roller, and so it does not deform significantly as the medium passes through the nip.

Figure 5C:
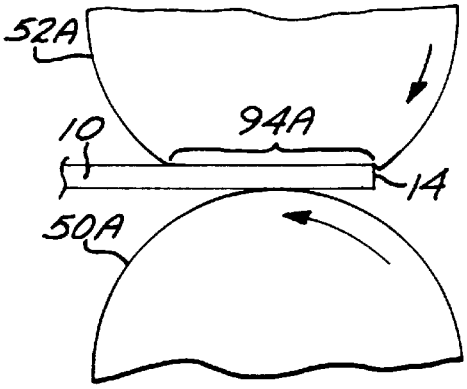
Figure 5D:
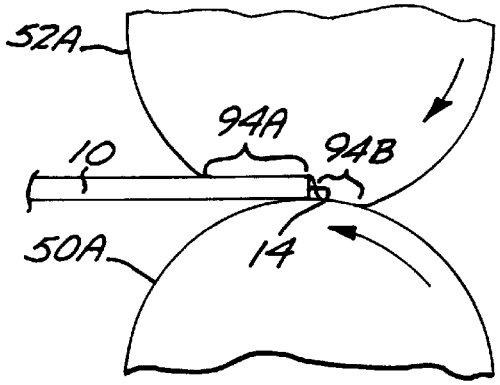
Figure 5E:
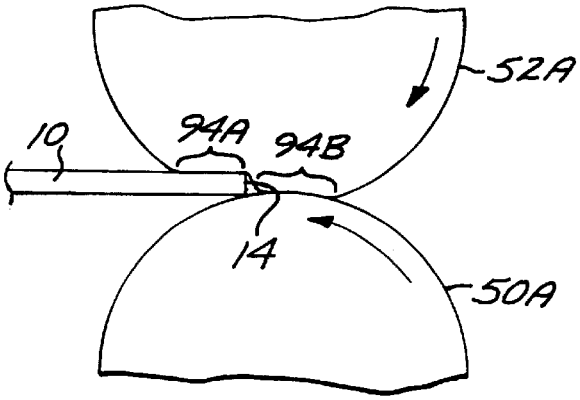
Figure 5F:
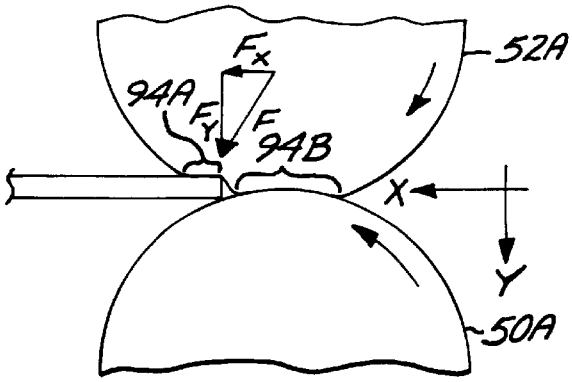

FIG. 5C shows the condition of the pinch roller 52 as the trailing end 14 of the medium 10 approaches the nip 51. FIG. 5D shows the trailing edge 14 at the nip, showing partial deformation, with the length of the medium-deformed portion 94A reduced in size since the trailing edge is now in the center of the nip. This process transfers an increasing proportion of the pinch roller force off the media and onto the drive roller 50. FIGS. 5E and 5F show progressively the trailing edge 14 leaving the nip. The medium-deformed portion 94A is now quite small in relation to the portion 94B of the pinch roller in contact with the drive roller, with most of the compressed portion of the foam tire in contact with the drive roller. FIG. 5F shows the force F applied by the pinch roller against the trailing edge 14. Force F is the resultant of force components $F_y$ and $F_x$, respectively indicating the force components directed transversely and parallel to the media path direction. The compliant roller 52 reduces the magnitude of the force component $F_x$ on the medium 10, and thereby reduces the hand-off error as the medium passes out of control of the rollers 50, 52.

The outer skin 96 provides a low coefficient of friction between the roller 52 and the media, and protects the media from contamination by the roller. The low coefficient of friction of the skin is useful for the exemplary embodiment, which employs a de-skew operation to de-skew the leading edge of the sheet as it is fed from an input source into the nip. The de-skew operation is described more fully in application Ser. No. 08/971,012. To address possible problems resulting from the sheet being misaligned or skewed with the feed path, a de-skew operation is conducted. In general, for the de-skew operation, the roller 50 is not driven and remains stationary while the leading edge is advanced to the nip. The picked sheet is presented to the pre-scan rollers 50, 52, which are stationary due to a one-way clutch which delivers drive force to pre-scan roller only when the motor 40 is driven in the forward direction. As the leading edge reaches the nip between the stationary pre-scan rollers 50 and the corresponding pinch rollers 52, any skew will be corrected, since if the edge reaches one nip before the other, it will be held there until the edge also reaches the other nip, therefore aligning the leading edge with the two nips. The roller 50 can now be driven, with any skew corrected.

The reason a skin with a low coefficient of friction is helpful in the de-skew operation is illustrated in FIGS. 6A–6B and 7A–7B. FIG. 6A is a top view illustrates the leading edge 12 of a sheet approaching the nips between the spaced sets of rollers, with rollers 52A, 52B representing the spaced pinch rollers which engage with corresponding drive rollers (not shown in FIG. 6A or 6B) to create the nips. In FIG. 6A, the leading edge is skewed, and reaches the nip for roller 52A before it reaches the nip for roller 52B. Because the roller sets are held stationary, the skew will be corrected, as the sheet is slightly overdriven in the nip to force de-skewing. Upon completion of the de-skew, the leading edge 12 is aligned in the respective nips. FIG. 7A shows the approach of the leading edge 12 into the nip formed by drive roller 50A and pinch roller 52A. The leading edge impacts the pinch roller at some angle 0, and will slide down the side of the pinch roller into the nip. The low coefficient of friction between the skin of the pinch roller and the leading edge of the sheet assists the movement of the leading edge into the nip.

In some embodiments, e.g. in applications not requiring a de-skew operation as just described, the skin will be omitted from the roller 52. The skin is not necessary for reduction of the hand-off error between one set of driven rollers and another set of driven rollers. The polyester material for the skin does not stretch, and so it reduces the benefit of the soft foam tire. Alternatively, the skin can comprise a material which has a low coefficient of friction and stretches under the forces applied during typical force. In this case, the sleeve of such a stretchy material is not linearly inelastic.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A sheet handling system including at least one drive roller and a pinch roller positioned to create a nip into which a paper sheet having a leading edge is passed, the pinch roller comprising:

a compressible core member; and a compliant skin covering a outer surface of the core member, the skin being formed of a material having a low coefficient of friction with respect to the paper sheet, wherein the nip is formed between an outer surface of the compliant skin and an outer surface of the drive roller, and wherein there is slippage between at least a leading edge portion of the paper sheet and the compliant skin of the pinch roller.

2. The sheet handling system of claim 1 wherein the core member comprises a soft foam member having a cylindrical outer surface, said skin having an inner surface in contact with said cylindrical outer surface of said foam member.

3. The sheet handling system of claim 1 wherein said skin is a layer of polyester having a thickness in the range of about 0.03 mm to 0.07 mm.

4. The sheet handling system of claim 1 wherein said core comprises a foam material having a hardness in the range of Shore-A 3 to Shore-A 35.

5. The sheet handling system of claim 1 wherein said skin is a sleeve member fitted about the outer periphery of the core.

6. The sheet handling system of claim 5 wherein said sleeve member is formed of a linearly inelastic material.

7. The sheet handling system of claim 1 wherein said core comprises a foam tire having a central opening formed therein.

8. The sheet handling system of claim 7 further comprising a shaft axle extending through the central opening.

9. The sheet handling system of claim 8 wherein said shaft axle include a hollow hub member.

10. A sheet handling system, including:

a sheet path along which a sheet is passed during handling;

a first drive roller and a first pinch roller positioned at a first position along the sheet path to create a first nip into which a sheet is passed;

first apparatus for imparting a rotational drive force to the first drive roller;

a second drive roller and a second pinch roller positioned at a second position along the sheet path to create a second nip into which the sheet is passed after a leading edge of the sheet has passed through the first nip, and wherein the sheet is still under the influence of the first drive roller and the first pinch roller as the leading edge of the sheet enters the second nip;

second apparatus for imparting a rotational drive force to the second drive roller;

wherein the first pinch roller includes a soft compressible member having a hardness in the range of Shore-A 3 to Shore-A 35, the soft compressible member deformable by contact with the sheet to transfer a portion of the first pinch roller force off the media and onto the drive roller and to reduce the force applied to the sheet at the first nip in the direction of the sheet path, thereby reducing hand-off error in feed accuracy of the sheet.

11. The system of claim 10 wherein the compressible member comprises a soft foam member having a cylindrical outer surface.

12. The system of claim 10 wherein said first pinch roller has an outer diameter less than 50 mm.

13. The system of claim 10 wherein said compressible member comprises a foam tire having a central opening formed therein.

14. The system of claim 13 further comprising a shaft axle extending through the central opening.

15. The system of claim 14 wherein said shaft axle include a hollow hub member.

16. The system of claim 10, wherein the first pinch roller includes a compliant skin covering said outer surface of the compressible member, the skin being formed of a material having a low coefficient of friction with respect to plain paper, wherein the nip is formed between an outer surface of the compliant skin and an outer surface of the drive roller.

17. The system of claim 16 wherein said skin is a layer of polyester having a thickness in the range of about 0.03 mm to 0.07 mm.

18. The system of claim 16 wherein said skin is a sleeve member fitted about the outer periphery of the compressible member.

19. The system of claim 18 wherein said sleeve member is formed of a linearly inelastic material.

* * * * *